US009955771B2

(12) United States Patent
Caulier et al.

(10) Patent No.: US 9,955,771 B2
(45) Date of Patent: May 1, 2018

(54) DEVICE FOR PACKAGING AND APPLYING A COSMETIC PRODUCT

(71) Applicant: L'OREAL, Paris (FR)

(72) Inventors: Eric Caulier, Maignelay (FR); Marcel Sanchez, Aulnay Sois Bois (FR); Wendy Annonay, Paris (FR); Audrey Thenin, Meudon (FR)

(73) Assignee: L'OREAL, Paris (FR)

( * ) Notice: Subject to any disclaimer, the term of this patent is extended or adjusted under 35 U.S.C. 154(b) by 230 days.

(21) Appl. No.: 14/781,189

(22) PCT Filed: Mar. 27, 2014

(86) PCT No.: PCT/IB2014/060207
§ 371 (c)(1),
(2) Date: Sep. 29, 2015

(87) PCT Pub. No.: WO2014/155328
PCT Pub. Date: Oct. 2, 2014

(65) Prior Publication Data

US 2016/0051032 A1 Feb. 25, 2016

(30) Foreign Application Priority Data

Mar. 29, 2013 (FR) ..... 13 52917

(51) Int. Cl.
*A45D 40/26* (2006.01)
*A46B 1/00* (2006.01)
(Continued)

(52) U.S. Cl.
CPC ..... *A45D 40/267* (2013.01); *A46B 1/00* (2013.01); *A46B 3/005* (2013.01); *A46B 9/021* (2013.01);
(Continued)

(58) Field of Classification Search
CPC combination set(s) only.
See application file for complete search history.

(56) References Cited

U.S. PATENT DOCUMENTS 6,412,496 B1 7/2002 Gueret
6,581,610 B1 † 6/2003 Gueret
(Continued)

FOREIGN PATENT DOCUMENTS

EP 2604968 * 10/1998 ..... A45D 40/26
EP 1384417 A2 1/2004
(Continued)

OTHER PUBLICATIONS

Sep. 8, 2016 Office Action issued in European Patent Application No. 14718759.5.
(Continued)

*Primary Examiner* — David Walczak
(74) *Attorney, Agent, or Firm* — Oliff PLC

(57) ABSTRACT

Applicator (3) for applying a cosmetic, makeup or care product (P) to the eyelashes and/or eyebrows, comprising: —a stem (8), and—an applicator member (10) located at one end of the stem (8) and comprising: —a perforated support (11) extending along a longitudinal axis (X) and carrying applicator elements (12), and—an applicator part (14) over molded on the perforated support (11).

16 Claims, 4 Drawing Sheets

Figure 1:
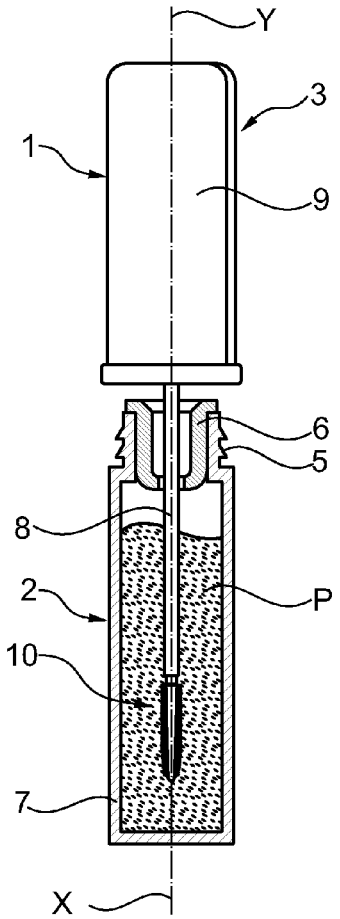

(51) Int. Cl.
*A46B 3/00* (2006.01)
*A46B 9/02* (2006.01)

(52) U.S. Cl.
CPC . *A46B 2200/106* (2013.01); *A46B 2200/1046* (2013.01); *A46B 2200/1053* (2013.01)

(56) References Cited

U.S. PATENT DOCUMENTS

| | | | | |
|---|---|---|---|---|
| 8,689,808 | B2 * | 4/2014 | Gueret | A45D 40/267 132/218 |
| 8,777,503 | B2 * | 7/2014 | Gueret | A45D 40/267 401/129 |
| 2002/0011251 | A1 * | 1/2002 | Gueret | A45D 40/267 132/218 |
| 2005/0034740 | A1 | 2/2005 | Eckers et al. | |
| 2005/0172439 | A1 † | 8/2005 | Weihrauch | |
| 2007/0033760 | A1 † | 2/2007 | Dumler | |
| 2007/0062552 | A1 | 3/2007 | De Brouwer et al. | |
| 2009/0095317 | A1 * | 4/2009 | Poetschl | A45D 40/26 132/320 |
| 2009/0193602 | A1 | 8/2009 | Dumler et al. | |
| 2011/0164914 | A1 | 7/2011 | Caulier | |
| 2012/0211019 | A1 † | 8/2012 | Wolfsgruber | |

FOREIGN PATENT DOCUMENTS

| | | | |
|---|---|---|---|
| EP | 1602300 | A1 | 12/2005 |
| EP | 2064968 | A2 † | 6/2009 |
| EP | 2084987 | A1 | 8/2009 |
| EP | 2332443 | A1 | 6/2011 |
| FR | 2890838 | A1 | 3/2007 |
| WO | 20111152927 | A1 | 12/2011 |

OTHER PUBLICATIONS

Apr. 25, 2016 Office Action issued in Chinese Patent Application No. 201480018875.2.
Jun. 16, 2014 International Search Report issued in International Patent Application No. PCT/IB2014/060207.
Jun. 16, 2014 Written Opinion issued in International Patent Application No. PCT/IB2014/060207.

* cited by examiner
† cited by third party

DEVICE FOR PACKAGING AND APPLYING A COSMETIC PRODUCT

The present invention relates to an applicator for applying a cosmetic product to the eyelashes and/or eyebrows, and also to a packaging and application device comprising such an applicator and a container containing the product to be applied.

Applicator members made at least partially by moulding plastics material are known.

It has thus been proposed to mount an applicator part moulded from a thermoplastic material on a support at the end of a stem of an applicator.

Application EP 2 332 443 discloses inserting the applicator part between two arms of the support. The mechanical connection between the two parts is imperfect and can result in a risk of accidental detachment.

Application FR 2 890 838 describes an applicator comprising a support formed by a rod which is fixed at one end in a housing of the stem and which comprises at the opposite end a widened head for retaining the applicator part on the rod. In certain situations, in particular when, in order to produce the applicator part, use is made of a thermoplastic material which swells in contact with a solvent in the product contained in the container, the applicator part can clear the widened head and detach from the applicator.

Consequently, there exists a need to ensure that the applicator part is fixed reliably to the applicator.

Application EP 1 602 300 describes an applicator member comprising an applicator part that is produced by overmoulding a core carrying a single row of teeth.

Application EP 1 384 417 discloses an applicator member formed by a rigid body surrounded by a sleeve carrying applicator elements.

Application WO 2011/152927 discloses an applicator comprising an outer applicator part having a hollow cavity and a moulded inner applicator part that is complementary to said outer part.

Application EP 2 084 987 describes an applicator comprising a hollow main body carrying bristles on its outer peripheral surface. Applicator elements are moulded by injection through through-bores formed in the wall of the main body.

There exists a need to benefit from new applicators that afford additional possibilities in terms of management of the eyelashes and makeup effects.

The invention aims to meet all or some of these objectives and achieves this aim by virtue of an applicator for applying a cosmetic, makeup or care product to the eyelashes and/or eyebrows, comprising:

- a stem, and
- an applicator member located at one end of the stem and comprising:
  - a perforated support extending along a longitudinal axis and carrying applicator elements, and
  - an applicator part overmoulded on the perforated support.

The material of the applicator part advantageously passes through the perforation or perforations in the support.

By virtue of the perforated nature of the support, the invention makes it possible for the applicator part to be held in a satisfactory manner after it has been overmoulded on the support, even if thermoplastic materials having very different properties are used to produce the support and the applicator part, without particular adhesion of one to the other.

By virtue of the invention, the connection between the support and the applicator part has increased mechanical strength and there is no risk of the applicator part accidentally detaching, even if the applicator part swells under the effect of a solvent contained in the product.

The mechanical connection between the perforated support and the applicator part can also be provided away from the application zone, and the user is thus not hampered during application of the product.

Materials Used

The applicator part is advantageously made of a material having a hardness less than that of the material of which the perforated support is made.

The applicator elements of the perforated support can thus have different characteristics from those of the applicator part, this being advantageous for making up the eyelashes and/or eyebrows; in one implementation example of the invention, the applicator elements of the support are advantageously designed to load the eyelashes, taking advantage of the fact that they are more rigid and have a greater load of product, and those of the applicator part are designed to separate the eyelashes, since they are more flexible and have a smaller load of product.

The perforated support stiffens the applicator member, and a very flexible material can be used for the applicator part.

The applicator part is advantageously made of a thermoplastic material, in particular an elastomer, for example SEBS, a silicone, latex, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, PET, POM, PBT, PA or PMMA. It is possible in particular to use the materials known under the trade names Hytrel®, Cariflex®, Alixine®, Santoprene®, Pebax®, this list not being limiting.

The applicator part may be made of a material having a hardness of between 40 Shore A and 80 Shore D, better still between 50 Shore A and 95 Shore A, while the perforated support is made of a material having a hardness greater than that of the material of which the applicator part is made. The perforated support is for example made of POM or PP and the applicator part is made of SEBS or Hytrel®.

The perforated support and the applicator part are advantageously made of materials having different colours, this making it possible to improve the aesthetic appearance and to remind the user of the presence of applicator elements having different properties.

Applicator Part

The applicator part may comprise a head that defines the distal end of the applicator.

The applicator part preferably extends, at its outer perimeter, around at least one complete circumference along the entire length of the applicator member from said head to the stem.

The applicator part may comprise a body that carries applicator elements that are formed for example by spikes, in particular having a conical shape, and are preferably oriented radially around the longitudinal axis of the perforated support. The applicator elements may have a semicircular section.

The applicator elements of the applicator part are preferably not individually injected through the perforated support.

The body of the applicator part may be thicker than the perforated support and is preferably less wide than the latter.

In one variant, the applicator part comprises at least two longitudinally opposite arms that carry the applicator elements. The arms of the applicator part may be rectilinear. In one variant, the longitudinal arms of the applicator part are curvilinear, being curved about one or more, convex or concave axes of curvature. The arms may be different from one another, one arm being for example rectilinear and another being curvilinear.

In this variant, after the applicator part has been overmoulded onto the perforated support, the applicator part has at least one material bridge, better still two material bridges, even better still three material bridges, connecting the longitudinal arms together and filling the openings, described below, in the perforated support.

The applicator part preferably has two opposite main faces that each carry the applicator elements.

The diameter of the envelope cylinder circumscribed at the free ends of the applicator elements of the applicator part may be between 5 mm and 12 mm, being for example equal to around 9 mm.

The applicator elements may be disposed on the applicator part in longitudinal rows on the two faces thereof. Each face may comprise at least two rows of applicator elements, better still at least three rows, for example four rows.

The angular offset, on each face, between two consecutive rows of applicator elements may be between 10° and 40°, being for example equal to 30°. This angular offset is measured at the base of the teeth, between the longitudinal mid-planes of the rows.

The applicator part may or may not comprise applicator elements at its distal end.

The visible length of the applicator part may be between 10 mm and 35 mm, better still between 20 mm and 26 mm, being for example equal to around 24 mm.

The body of the applicator part may have a flattened overall shape, wider than thick, the rows of teeth being carried by the main faces of said body.

The thickness of the body of the applicator part may be between 1 mm and 6 mm, better still between 2.5 mm and 4 mm, being for example equal to around 3 mm.

The width of the body of the applicator part may be between 1 mm and 7 mm, better still between 3 mm and 5 mm, being for example equal to 4 mm.

The applicator part may be overmoulded onto the perforated support before the latter is fixed to the stem.

Perforated Support

The perforated support may have a flattened overall shape.

The perforated support may comprise at least two opposite longitudinal arms, which may be rectilinear. In one variant, the longitudinal arms of the perforated support are curvilinear, being curved about one or more, convex or concave axes of curvature. The arms may be different from one another, one arm being for example rectilinear and another being curvilinear.

The width of the longitudinal arms of the perforated support, when the latter is viewed from above perpendicularly to the flattening plane of the support, may be between 1 mm and 7 mm, better still between 1.5 mm and 3 mm, being for example equal to 2 mm.

The longitudinal arms of the perforated support are preferably connected together by at least one material bridge moulded in one piece with the support. The longitudinal arms of the perforated support are advantageously connected together by at least two material bridges, the first material bridge being located for example close to the proximal end of the perforated support and the second material bridge being located for example close to the distal end thereof. The perforated support may also comprise a material bridge that connects the longitudinal arms together, approximately half-way between the proximal end and the distal end of the support.

The material bridge or bridges of the perforated support keep the longitudinal arms of the latter in a fixed manner with respect to one another. Moreover, they improve the mechanical strength of the applicator part. In particular, the material bridge located half-way between the proximal end and the distal end of the support is completely surrounded by the material of the applicator part, making the support and the applicator part impossible to be mechanically separated after the moulding of the applicator part over the support.

The material bridge or bridges of the perforated support advantageously have a circular cross section, having a diameter of preferably between 0.9 mm and 3 mm, being for example equal to 1.5 mm. In one variant, the cross section of the material bridge or bridges of the perforated support is not circular, being for example polygonal, in particular rectangular.

The longitudinal arms advantageously carry the applicator elements of the perforated support, on their opposite sides. These applicator elements may have a flattened cross section, with the width at the base thereof preferably corresponding to the width of the arm that carries them.

In one variant, the perforated support may comprise a body that has at least one opening. The body advantageously carries the applicator elements of the perforated support on two of its opposite sides. In this case, the applicator part is formed of at least two longitudinal arms, and the opening in the body of the perforated support is intended to be filled with the material of a material bridge of the applicator part.

In this case, the perforated support may comprise a head that defines the distal end of the applicator.

The body of the perforated support advantageously has two openings, the first being located for example close to the proximal end of the perforated support and the second being located for example close to the distal end thereof. The body of the perforated support may also have an opening approximately half-way between its proximal and distal ends.

The applicator elements of the perforated support are preferably disposed with their flattening plane oriented perpendicularly to the longitudinal axis of the support. This makes it possible, after the applicator member has been wiped, to provide reserves of product on the applicator member, and to define grooves, into which the eyelashes can be introduced, between the applicator elements.

The width of the applicator elements of the perforated support can decrease progressively towards their free end, such that the latter forms a point, this encouraging the introduction of the eyelashes and/or eyebrows between the applicator elements.

The length of the applicator elements of the perforated support can decrease progressively in the direction of the distal end of the latter. This makes it easier, when the applicator is dipped into a container containing the product to be applied, for the wiping member of the container to be overcome.

The diameter of the envelope cylinder circumscribed at the free ends of the applicator elements of the perforated support having a shorter length may be between 3 mm and 14 mm, for example between 4 mm and 6 mm. The diameter of the envelope cylinder circumscribed at the free ends of the applicator elements of the perforated support having a longer length may be between 3 mm and 14 mm, for example between 5.5 mm and 7.5 mm.

The offset between two consecutive applicator elements of the perforated support, measured at their base, between their adjacent flanks, may be between 0.4 mm and 3 mm, being for example equal to 0.6 mm.

The perforated support may comprise, at its proximal end, a fixing end piece designed to be accommodated in a housing of the stem.

When the perforated support is formed by at least two longitudinal arms, this end piece may be internally hollowed out, opening out at least on the side of the applicator part. The applicator part may be overmoulded onto the perforated support such that the hollow in the end piece is at least partially filled with the material of the applicator part. The hold of the applicator part on the perforated support is thus reinforced.

The end piece may be hollowed out along at least half of its length, it being possible for the hollow not to pass through.

When the perforated support comprises a body and the applicator part is formed by at least two longitudinal arms, the perforated support may comprise an end piece which is covered by the material of the applicator part so as to form a fixing end piece designed to be accommodated in a housing of the stem.

The perforated support may be formed by a part attached to the stem of the applicator, the end piece being for example clipped into a housing in the stem, and/or the latter being pressed onto the end piece.

The perforated support preferably has a rectilinear longitudinal axis, but the latter may be curvilinear.

The visible length of the applicator member may be between 10 mm and 35 mm, better still between 22 mm and 26 mm, being for example equal to around 23.5 mm.

Stem

At its end opposite the applicator member, the stem is preferably connected to a gripping member. The stem may be snap-fastened onto a part of this gripping member.

The stem may have a circular cross section.

The stem may comprise at least one elastically deformable flexible portion, being able to flex during application and/or when the applicator member is wiped. The perforated support may be fixed to the flexible portion of the stem. In particular, the flexible portion of the stem may comprise a housing, and the perforated support, in particular the fixing end piece of the latter, may be inserted into this housing.

The flexible portion of the stem may be provided with an annular groove, in order to increase its flexibility.

Packaging and Application Device

A further subject of the invention is a device for packaging and applying a cosmetic, makeup or care, product to the eyelashes and/or eyebrows, comprising an applicator according to the invention, as defined above, and a container containing the product to be applied.

The gripping member of the applicator may form a cap for closing the container in a sealed manner.

The container may comprise a member for wiping the applicator.

The stem may comprise a narrowing which is positioned opposite the wiping member in the closed configuration of the container.

Figure 2:
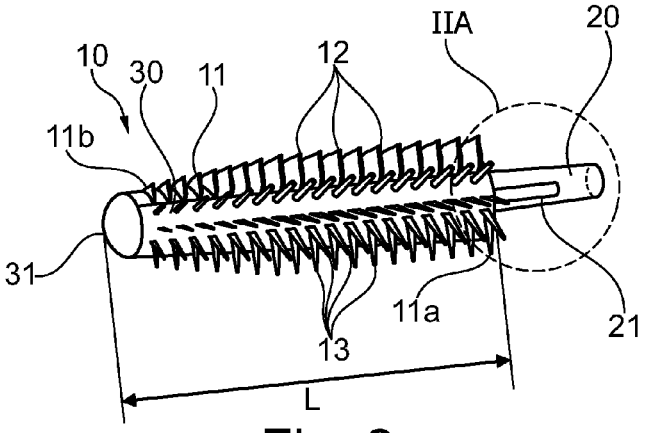
Figure 2A:
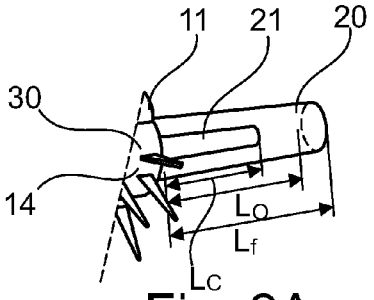
Figure 3:
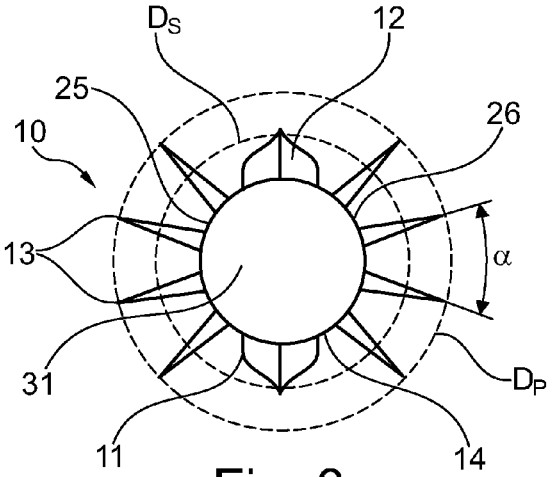
Figure 4:
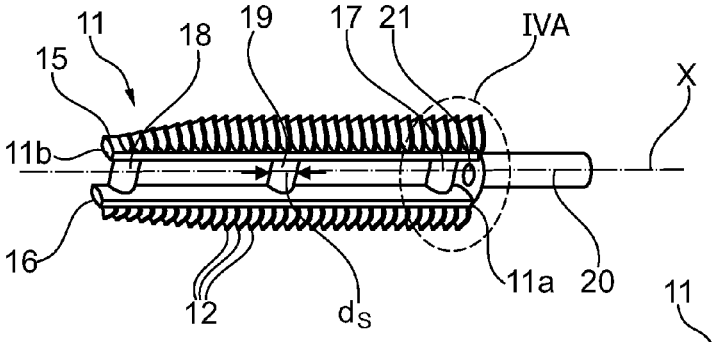
Figure 4A:
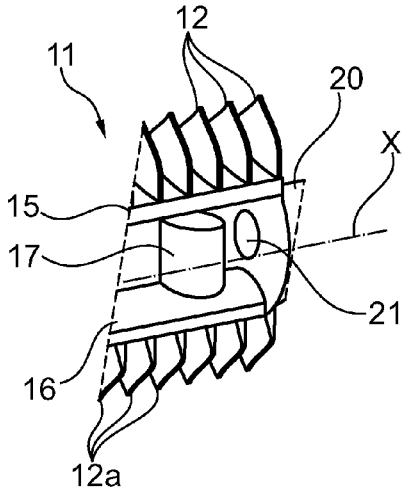
Figure 5:
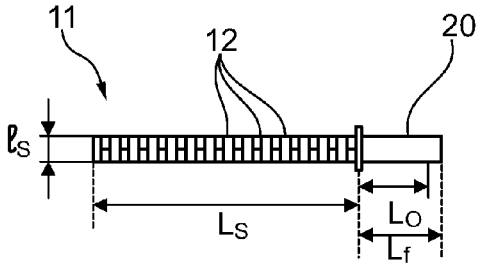
Figure 6:
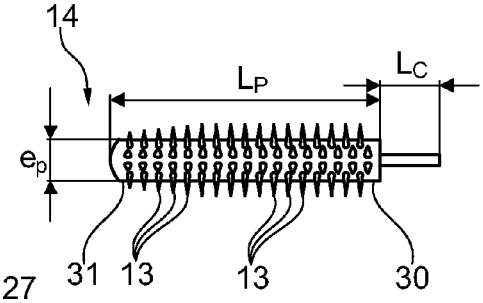
Figure 7:
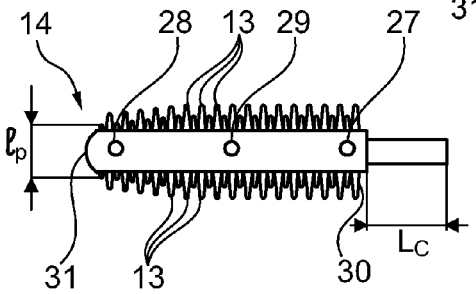
Figure 8:
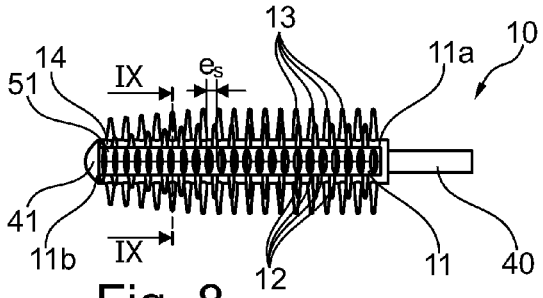
Figure 9:
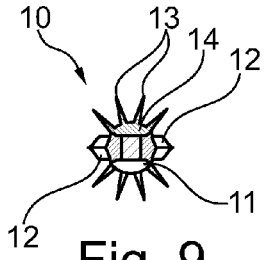
Figure 10:
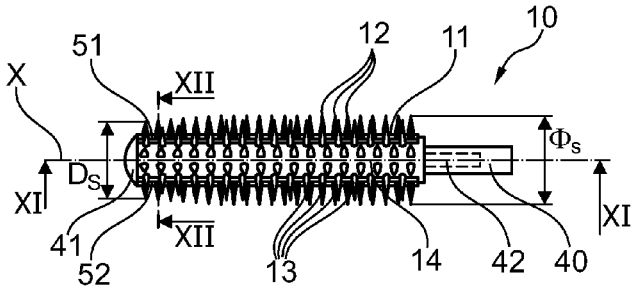
Figure 12:
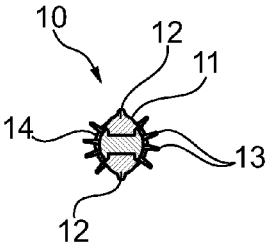
Figure 11:
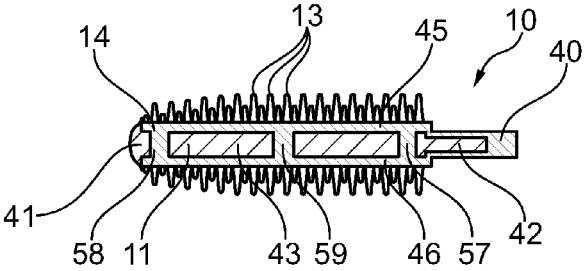
Figure 13:
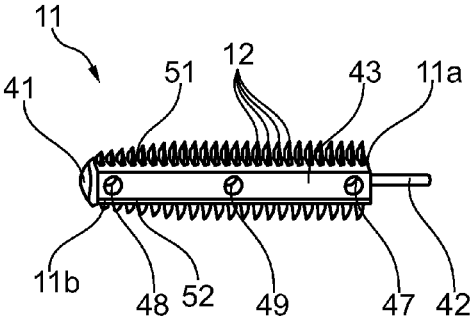
Figure 14:
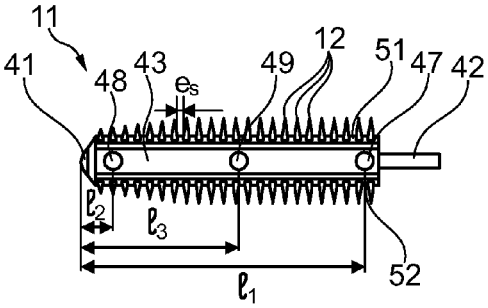
Figure 15:
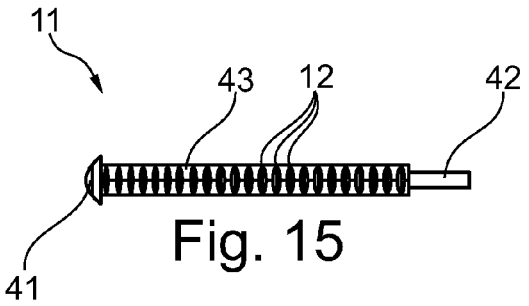
Figure 16:
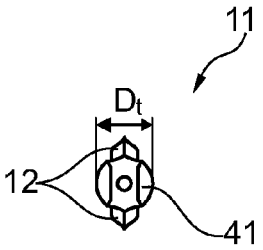
Figure 17:
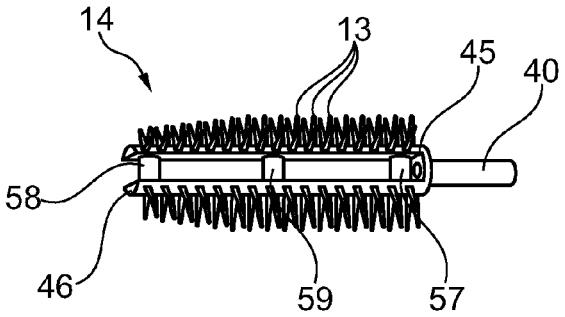
Figure 18:
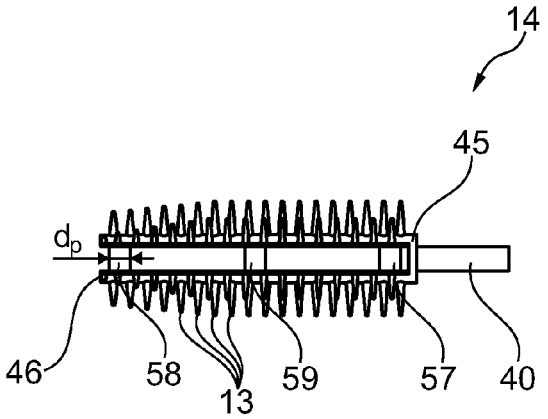
Figure 19:
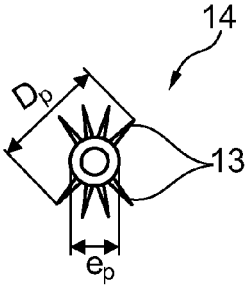
Figure 20:
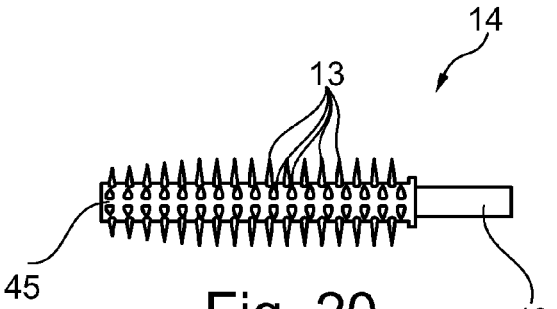

The invention may be better understood from reading the following detailed description of a non-limiting implementation example thereof, and with reference to the attached drawing, in which:

FIG. 1 schematically shows an example of a packaging and application device produced in accordance with the invention, in longitudinal section, FIG. 2 shows a side view of the applicator member from FIG. 1 on its own, FIG. 2A is a detail of the applicator member from FIG. 2, FIG. 3 shows a front view of the applicator member from FIG. 1 on its own, FIG. 4 shows a side view of the perforated support of the applicator member from FIGS. 1 to 3 on its own, FIG. 4A is a detail of the perforated support from FIG. 4, FIG. 5 shows a top view of the perforated support of the applicator member from FIGS. 1 to 3 on its own, FIG. 6 shows a side view of the applicator part of the applicator member from FIGS. 1 to 3 on its own, FIG. 7 shows a top view of the applicator part of the applicator member from FIGS. 1 to 3 on its own, FIG. 8 schematically shows a top view of a variant of an applicator member according to the invention, FIG. 9 is a section along IX-IX of the applicator member from FIG. 8, FIG. 10 shows a side view of the applicator member from FIG. 8, FIG. 11 is a section along XI-XI of the applicator member from FIG. 10, FIG. 12 is a section along XII-XII of the applicator member from FIG. 10, FIG. 13 shows a side view of the perforated support of the applicator member from FIGS. 8 to 12 on its own, FIG. 14 schematically shows a side view of the perforated support from FIG. 13 on its own, FIG. 15 schematically shows a top view of the perforated support from FIG. 13 on its own, FIG. 16 schematically shows a front view of the perforated support from FIG. 13 on its own, FIG. 17 shows a top view of the applicator part of the applicator member from FIGS. 8 to 12 on its own, FIG. 18 schematically shows a top view of the applicator part from FIG. 17 on its own, FIG. 19 schematically shows a rear view of the applicator part from FIG. 17 on its own, and FIG. 20 schematically shows a side view of the applicator part from FIG. 17 on its own.

The packaging and application device 1 shown in FIG. 1 comprises a container 2 containing a product P to be applied to the eyelashes and/or eyebrows and an applicator 3 which may be fixed removably to the container 2.

The applicator 3 comprises a stem 8 of longitudinal axis Y, which is provided at one end with an applicator member 10 and at the other end with a gripping member 9 that likewise forms a cap for closing the container 2 in a sealed manner. The latter comprises a body 7 which is provided at the top with a threaded neck 5 onto which the gripping member 9 can be screwed in order to close the container 2 in a sealed manner. In a variant, the applicator 3 can be fixed to the container 2 in some other way.

The neck 5 may accommodate, as illustrated, a wiping member 6 which is for example inserted into the neck 5. This wiping member 6 comprises for example a lip that defines a wiping orifice having a diameter adapted to that of the stem 8. The wiping member 6 may be of any type, connected to the container 2 or moulded together therewith. The wiping member 6 may also be adjustable. Alternatively, the neck 5 of the container 2 may be attached.

In the example illustrated, the stem 8 has a rectilinear longitudinal axis Y, but if the stem 8 is not rectilinear, this does not depart from the scope of the present invention. The stem 8 may comprise a flexible part at its distal end, optionally provided with an annular groove, the applicator member 10 then being attached to this flexible part.

The product P is intended to be applied to the eyelashes and/or eyebrows. It may comprise iron oxide, among other pigments, and an aqueous or organic solvent, depending on the formulation.

All or part of the applicator member 10 has been schematically illustrated on its own in FIGS. 2 to 7.

The applicator member 10 comprises a perforated support 11, visible in FIG. 4, that extends along a longitudinal axis X, which is rectilinear in the example described.

The perforated support 11 carries applicator elements 12 and comprises, at its proximal end 11*a*, a fixing end piece 20 designed to be fixed in a housing of the stem 8.

The applicator member 10 comprises an applicator part 14 overmoulded onto the perforated support 11 and formed by a body 30 that carries applicator elements 13, which are formed by conical spikes in the example described. These applicator elements 13 are, in this example, oriented radially around the longitudinal axis X of the perforated support 11.

In the example described, the applicator part 14 comprises a head 31 that defines the distal end of the applicator 3. The applicator part 14 extends, at its outer perimeter, around at least one complete circumference along the entire length of the applicator member 10 from said head 31 to the stem 8.

The injection point of the material of the applicator part 14 onto the perforated support 11 is located for example at the distal end 11*b* of the latter.

The visible length L of the applicator member 10 is preferably between 22 mm and 26 mm.

The applicator part 14 is preferably made of a material that is more flexible than that of the perforated support 11. The applicator part 14 and the perforated support 11 are advantageously produced from materials having different colours.

In the example in question, the fixing end piece 20 of the perforated support 11 is internally hollowed out, for example along two thirds of its length $L_o$.

The applicator part 14 is overmoulded onto the perforated support 11 such that the material fills this hollow 21 over a corresponding length $L_c$, in the example described, along around two thirds of the length $L_o$ of the end piece 20.

The length $L_f$ of the end piece 20 of the perforated support 11 may be between 5 mm and 10 mm, better still between 6 mm and 9 mm.

As shown in FIG. 3, the applicator part 14 has two opposite faces 25 and 26 carrying the applicator elements 13. The latter are disposed, in the example described, in four longitudinal rows on each face 25, 26 of the applicator part 14. However, the invention is not limited to a particular number of rows of applicator elements or a particular arrangement of the latter.

The angular offset a between two consecutive rows of applicator elements 13 may be between 10° and 40°, being equal to 30° in the example in question.

The diameter $D_p$ of the envelope cylinder circumscribed on the applicator elements 13 of the applicator part 14 may be between 5 mm and 12 mm, being equal to around 9 mm in the example in question.

In the example in question, the perforated support 11 comprises two opposite longitudinal arms 15 and 16 that are connected together by three material bridges 17, 18, 19, which are visible in FIG. 4. However, the invention is not limited to a particular number of arms and of material bridges of the perforated support.

The longitudinal arms 15, 16 of the perforated support 11 are rectilinear in the example described and parallel to the axis X.

The material bridges 17, 18, 19 have a circular cross section in the example in question, having a diameter $d_s$ of between 0.9 mm and 3 mm, for example equal to 1.5 mm.

The third material bridge 19 is located approximately half-way between the proximal end 11*a* and the distal end 11*b* of the support 11.

As is visible in FIG. 4, the length of the applicator elements 12 of the perforated support 11 can decrease progressively in the direction of the distal end 11*b* of the latter.

The diameter $D_s$ of the envelope cylinder circumscribed at the free ends of the applicator elements 12 of the perforated support 11 having a shorter length may be between 3 mm and 14 mm, better still between 4 mm and 6 mm, being for example equal to 5.4 mm. The diameter $\Phi_s$ of the envelope cylinder circumscribed at the free ends of the applicator elements 12 of the perforated support having a longer length may be between 3 mm and 14 mm, for example between 5.5 mm and 7.5 mm, being for example equal to 6.9 mm.

The applicator elements 12 of the perforated support 11 have a flattened cross section. Their width decreases progressively towards their free end 12*a* so as to form a point.

The applicator elements 12 of the perforated support 11 are oriented perpendicularly to the longitudinal axis X. However, the invention is not limited to a particular shape and arrangement of the applicator elements 12.

As shown in FIGS. 8 and 14, the offset $e_s$ between two consecutive applicator elements 12 of the perforated support 11, measured at their base, between their adjacent flanks, is between 0.4 mm and 3 mm, being for example equal to 0.6 mm.

The perforated support 11 has a flattened overall shape.

The width $l_s$ of the longitudinal arms of the perforated support 11 may be between 1 mm and 7 mm, better still between 1.5 mm and 3 mm, being equal to 2 mm in the example in question.

The length $L_s$ of the perforated support 11, not including the end piece 20, may be between 10 mm and 35 mm, better still between 20 mm and 26 mm.

FIGS. 6 and 7 show the applicator part 14 on its own.

The body 30 of the applicator part 14 is thicker and less wide than the perforated support 11.

The visible length $L_p$ of the applicator part 14 may be between 10 mm and 35 mm, better still between 20 mm and 26 mm.

The thickness $e_p$ of the body 30 of the applicator part 14 may be between 1 mm and 6 mm, better still between 2.5 mm and 4 mm, being equal to 3.1 mm in the example in question.

The width $l_p$ of the body 30 of the applicator part 14 may be between 1 mm and 7 mm, better still between 3 mm and 5 mm, being equal to 4 mm in the example described.

The applicator part 14 has openings 27, 28, 29, visible in FIG. 7, which correspond to the passage of the material bridges 17, 18 and 19.

In the variant shown in FIGS. 8 to 20, the applicator part 14 is formed by at least two opposite longitudinal arms 45, 46 that carry the applicator elements 13. As shown in FIGS. 11, 17 and 18, the arms 45, 46 of the applicator part 14 are rectilinear in the example described.

As shown in FIGS. 13 to 16, the perforated support 11 then comprises a body 43 that has three openings 47, 48 and 49 in the example in question. The first opening 47 in the perforated support 11 is located close to its proximal end 11*a* and the second opening 48 is located close to its distal end 11*b*. The third opening 49 is located approximately half-way between the proximal and distal ends 11*a* and 11*b* of the perforated support 11. The openings 47, 48, 49 in the perforated support 11 have a circular section in the example in question.

The centre of the first opening 47 in the perforated support 11 is located at a distance $l_1$ from the distal end 11*b* of the latter, said distance being between 20 mm and 25 mm, being for example equal to 22.47 mm. The centre of the second opening 48 in the perforated support 11 is located at a distance $l_2$ from the distal end 11*b* of the latter, said distance being between 1.5 mm and 5 mm, being for example equal to 2.47 mm. The centre of the third opening 49 in the perforated support 11 is located at a distance $l_3$ from the distal end 11*b* of the latter, said distance being between 10 mm and 15 mm, being for example equal to 12.47 mm.

The body 43 carries the applicator elements 12 of the perforated support 11 on two of its opposite sides 51, 52.

The perforated support 11 comprises a head 41 that defines the distal end of the applicator 3, the diameter $D_t$ of which is between 3 mm and 5 mm, being for example equal to 4 mm. Thus, in this example, the perforated support 11 has a longer length than the applicator part 14.

The openings 47, 48 and 49 in the body 43 of the perforated support 11 are intended to be filled with the material of the applicator part 14, as is visible in FIG. 11. After the applicator part 14 has been overmoulded onto the perforated support 11, said applicator part 14 then has three material bridges 57, 58 and 59, visible in FIGS. 11, 17 and 18, which connect the longitudinal arms 45 and 46 of the applicator part 14 together. The material bridges 57, 58, 59 have a circular cross section in the example in question, having a diameter $d_p$ of between 0.9 mm and 3 mm, for example equal to 1.5 mm.

In the example in FIGS. 8 to 20, the perforated support 11 comprises an end piece 42 covered by the material of the applicator part 14, as is visible in FIGS. 10 and 11, so as to form a fixing end piece 40 designed to be accommodated in a housing of the stem 8.

The invention is not limited to the examples that have just been described.

The perforated support 11 may comprise only two material bridges, for example not comprising the material bridge 19 located half-way between its proximal end 11*a* and distal end 11*b*. When the perforated support 11 comprises a body 43, the latter may have only two openings, for example not comprising the opening 49 located half-way between the proximal end 11*a* and distal end 11*b* of the perforated support 11.

When it is formed by a body 30, the applicator part 14 may comprise applicator elements on its head 31 that defines the distal end of the applicator 3.

The applicator elements 12 and 13 may comprise a material that has bacteriostatic properties and/or promotes slip and/or is magnetic.

The applicator 3 may be subjected to vibrations during use, and/or be heated, that is to say comprise a heating element, and/or be able to rotate. It is also possible for the applicator member 10 to be able to vibrate and to be heated or only to be able to vibrate or only to be heated or only to be able to rotate. When the applicator is able to rotate, the gripping member 9 may house an electric motor for rotating the stem.

The expression "comprising a" should be understood as being synonymous with "comprising at least one".

The invention claimed is:

1. An applicator for applying a cosmetic, makeup or care product to the eyelashes and/or eyebrows, comprising:

a stem, and an applicator member located at one end of the stem and comprising:

a perforated support extending along a longitudinal axis and carrying applicator elements, and an applicator part overmoulded on the perforated support, wherein the perforated support comprises at least two longitudinally opposite arms and three material bridges connecting said at least two arms together, and wherein the bridges extend along axes that are perpendicular to and intersecting the longitudinal axis of the support.

2. An applicator for applying a cosmetic, makeup or care product to the eyelashes and/or eyebrows, comprising:

a stem, and an applicator member located at one end of the stem and comprising:

a perforated support extending along a longitudinal axis and carrying applicator elements, and an applicator part overmoulded on the perforated support, wherein the perforated support comprises only two longitudinally opposite arms connected together by material bridges, each arm extending along an axis, both axes being coplanar, the applicator part comprising openings which correspond to the passage of the material bridges.

3. The applicator according to claim 2, wherein the at least two longitudinally opposite arms are connected together by three material bridges, the third material bridge connecting the longitudinal arms half-way between a proximal end and a distal end of the perforated support.

4. An applicator for applying a cosmetic, makeup or care product to the eyelashes and/or eyebrows, comprising:

a stem, and an applicator member located at one end of the stem and comprising:

a perforated support extending along a longitudinal axis and carrying applicator elements, and an applicator part overmoulded on the perforated support, wherein the perforated support comprises a body which has at least two openings, the applicator part being formed by at least two longitudinal arms, said at least two openings in the perforated support being filled with the material of the applicator part so as to form at least two material bridges that connects the longitudinal arms of the applicator part together, the applicator elements of the perforated support having a flattened cross section and being oriented with a flattening plane perpendicular to the longitudinal axis.

5. The applicator according to claim 1, wherein the applicator part is made of a material having a hardness less than that of the material of which the perforated support is made.

6. The applicator according to claim 5, wherein the perforated support comprises a body which has at least one opening, the applicator part being formed by at least two longitudinal arms, said at least one opening in the perforated support being intended to be filled with a material of the applicator part so as to form at least one of the material bridges that connects the longitudinal arms of the applicator part together.

7. The applicator according to claim 1, wherein the perforated support and the applicator part are made of materials having different colours.

8. The applicator according to claim 1, wherein the longitudinal arms of the perforated support are rectilinear.

9. The applicator according to claim 1, wherein the applicator part comprises a head that defines the distal end of the applicator.

10. The applicator according to the preceding claim, wherein the applicator part extends, at its outer perimeter, around at least one complete circumference along the entire length of the applicator member from said head to the stem.

11. The applicator according to claim 1, wherein the perforated support has a flattened overall shape, the applicator part comprising a body that carries the applicator elements, the body being thicker than the perforated support.

12. The applicator according to claim 1, wherein the perforated support comprises at its proximal end a fixing end piece accommodated in a housing of the stem.

13. The applicator according to the preceding claim, wherein the fixing end piece is internally hollowed out and at least partially filled with a material of the applicator part.

14. The applicator according to claim 1, wherein the perforated support carries two rows of applicator elements located opposite one another.

15. The applicator according to claim 1, wherein the applicator part carries applicator elements formed by spikes.

16. A device for packaging and applying a cosmetic, makeup or care product to the eyelashes and/or eyebrows, comprising an applicator as defined in any one of claim 1 and a container containing the product to be applied.

* * * * *